US009761118B2

(12) United States Patent
Lee

(10) Patent No.: US 9,761,118 B2
(45) Date of Patent: Sep. 12, 2017

(54) DETECTING APPARATUS AND METHOD, AND MOBILE TERMINAL APPARATUS HAVING DETECTING APPARATUS

(75) Inventor: Ho-Sub Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 155 days.

(21) Appl. No.: 13/104,901

(22) Filed: May 10, 2011

(65) Prior Publication Data

US 2012/0032806 A1 Feb. 9, 2012

(30) Foreign Application Priority Data

Aug. 6, 2010 (KR) ..... 10-2010-0076111

(51) Int. Cl.
*G08B 23/00* (2006.01)

(52) U.S. Cl.
CPC ..... *G08B 23/00* (2013.01)

(58) Field of Classification Search
None
See application file for complete search history.

(56) References Cited

U.S. PATENT DOCUMENTS

| | | | | |
|---|---|---|---|---|
| 6,028,514 | A * | 2/2000 | Lemelson et al. | 340/539.13 |
| 7,505,784 | B2 | 3/2009 | Barbera | |
| 2003/0153846 | A1* | 8/2003 | Marple-Horvat | 600/587 |
| 2005/0068171 | A1* | 3/2005 | Kelliher et al. | 340/539.22 |
| 2005/0146600 | A1* | 7/2005 | Chipchase et al. | 348/14.02 |
| 2006/0261978 | A1* | 11/2006 | Yokota et al. | 340/933 |
| 2008/0068158 | A1* | 3/2008 | Sumiyoshi et al. | 340/540 |
| 2008/0094230 | A1* | 4/2008 | Mock et al. | 340/573.4 |
| 2009/0005220 | A1 | 1/2009 | Lee et al. | |
| 2009/0137933 | A1* | 5/2009 | Lieberman et al. | 600/595 |
| 2009/0181640 | A1* | 7/2009 | Jones | G08B 13/196 455/404.2 |
| 2011/0175932 | A1* | 7/2011 | Yu et al. | 345/661 |
| 2012/0095722 | A1* | 4/2012 | Ten Kate | 702/141 |
| 2012/0101411 | A1* | 4/2012 | Hausdorff et al. | 600/595 |

FOREIGN PATENT DOCUMENTS

| | | | |
|---|---|---|---|
| JP | 2002-345020 | A | 11/2002 |
| JP | 2006174288 | A * | 6/2006 |
| JP | 2007-241867 | | 9/2007 |
| JP | 2007-315781 | | 12/2007 |
| JP | 2007-334609 | A | 12/2007 |
| JP | 2008-053988 | | 3/2008 |
| JP | 2008085510 | A * | 4/2008 |
| JP | 2008-148156 | | 6/2008 |
| JP | 2009-015494 | | 1/2009 |

(Continued)

OTHER PUBLICATIONS

Korean Office Action issued on Jul. 26, 2016 in counterpart Korean Patent Application No. 10-2010-0076111 (13 pages in Korean with English translation).

*Primary Examiner* — Brian Zimmerman
*Assistant Examiner* — Kevin Lau
(74) *Attorney, Agent, or Firm* — NSIP Law

(57) ABSTRACT

A detecting apparatus for a mobile terminal, including a determination unit configured to determine whether a user's attention is preoccupied, and a warning unit configured to provide an alert, in response to the determination unit determining that the user's attention is preoccupied.

14 Claims, 6 Drawing Sheets

(56) References Cited

FOREIGN PATENT DOCUMENTS

| | | | | |
|---|---|---|---|---|
| KR | 10-2006-0008106 | | | 1/2006 |
| KR | 10-2006-0080297 | | | 7/2006 |
| KR | 2007058720 | A | * | 6/2007 |
| KR | 10-2007-0101672 | | | 10/2007 |
| KR | 10-2009-0025512 | | | 3/2009 |

* cited by examiner

FIG. 3

302

303

| Walking speed / Walking state | 1~3 | 4~6 | 7~9 | ... |
|---|---|---|---|---|
| Walk | 2 | 4 | 6 | ... |
| Run | 4 | 8 | 12 | ... |
| ... | ... | ... | ... | ... |

DETECTING APPARATUS AND METHOD, AND MOBILE TERMINAL APPARATUS HAVING DETECTING APPARATUS

CROSS-REFERENCE TO RELATED APPLICATION

This application claims the benefit under 35 U.S.C. §119 (a) of a Korean Patent Application No. 10-2010-0076111, filed on Aug. 6, 2010, the entire disclosure of which is incorporated herein by reference for all purposes.

BACKGROUND

1. Field

The following description relates to a detecting apparatus and method, and more particularly, to an apparatus and a method for detecting an event or a potential event for a mobile terminal.

2. Description of the Related Art

With improvements to software and/or hardware of mobile terminals, users are able to access various contents, such as digital multimedia broadcasting (DMB) contents, E-books, games, movies, and so on, through their mobile terminals. The portable feature of the mobile terminals has also allowed users to appreciate these contents while in transit. In some cases, however, users have become preoccupied with their mobile terminals and less aware of the potential dangers around them.

For example, there have been reports of personal injury due to the use of mobile terminals while walking. It has been reported that some users even forget the fact that they are walking while immersed in tasks performed with their mobile terminals, for example, walking while exchanging text messages.

With further development of mobile technologies and increasing availability of contents, there are concerns that more users may pay less attention to their surrounding, and potentially placing them and others around them in harm's way.

SUMMARY

In one general aspect, there is provided a detecting apparatus for a mobile terminal, including a determination unit configured to determine whether a user's attention is preoccupied; and a warning unit configured to provide an alert, in response to the determination unit determining that the user's attention is preoccupied.

In another general aspect, there is provided a detecting apparatus for a mobile terminal, including a first determination unit configured to determine whether a user's attention is preoccupied, a second determination unit configured to determine one or more factors indicative of danger to the user utilized by the detecting apparatus to provide an alert, and a warning unit configured to provide an alert based on a determination of the first determination unit, a determination of the second determination unit, or a combination thereof.

In another general aspect, there is provided a detecting method for a mobile terminal, the method including determining by a determination unit, whether a user's attention is preoccupied, and providing an alert by a warning unit, in response to determining that the user's attention is preoccupied.

In another general aspect, there is provided a detecting method for a mobile terminal, the method including determining by a first determination unit, whether a user's attention is preoccupied, determining by a second determination unit, one or more factors indicative of danger to the user utilized to provide an alert, and providing an alert by a warning unit, based on whether the user is preoccupied, the one or more factors, or a combination thereof.

In another general aspect, there is provided a mobile terminal including a data collector configured to include one or more modules among a GPS module to measure a user's walking speed, an accelerometer module to detect the user's walking state and/or stability, a proximity sensor module to detect an object approaching the user, a network module to receive information through a communication network, a camera module to collect information about the user or the user's surrounding, and a microphone module to detect sound or noise around the user, a determination unit configured to determine whether the user's attention is preoccupied, whether the user is walking, whether there is a walking-related danger, or whether there is an environmental danger, based on information collected by the data collector, and a warning unit configured to provide an alert in response to the user's attention being preoccupied, in response to there being a walking-related danger, or in response to there being an environmental danger, according to a determination by the determination unit.

Other features and aspects will be apparent from the following detailed description, the drawings, and the claims.

BRIEF DESCRIPTION OF THE DRAWINGS

FIG. 3 shows an example of a database for use in a detecting apparatus.

Figure 1:
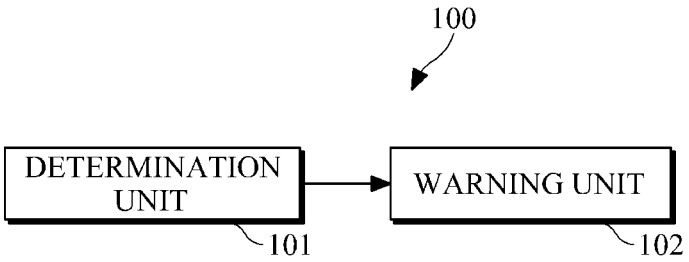
FIG. 1 is a diagram illustrating an example of a detecting apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

FIG. 1 shows an example of a detecting apparatus 100 that may be provided in a mobile terminal (not shown). As a non-limiting illustrative purpose only, a mobile terminal as referred to herein may be a mobile phone, a smart phone, a tablet PC or pad, a personal digital assistant (PDA), a portable multimedia player (PMP), a portable game counsel, a handheld e-book, a global positioning system (GPS) navigation device, a digital camera, and the like.

The detecting apparatus 100 may detect factors that may pose as danger and inform the user in response to, for example, the user using the mobile terminal while moving. As an example, when a user is walking and checking emails through the mobile terminal, the user may be distracted and unaware of a car approaching the user. In this example, the detecting apparatus 100 provided in the mobile terminal may sound an alarm to warn the user.

As shown in FIG. 1, the detecting apparatus 100 may include a determination unit 101 and a warning unit 102.

The determination unit 101 determines whether a user's attention is preoccupied. The determination unit 101 may determine the relationship between the user and the mobile terminal, for example, the user's attention with respect to the mobile terminal. For example, if the user's attention is focused on a target, the user's eyes may be gazing or fixed to the target for a longer period of time and the user may also blink his or her eyes less. According to an embodiment, the determination unit 101 may determine whether the user is concentrating his or her attention on the mobile terminal, based on information about movement of the user's eyes (or eye) through a camera of the mobile terminal. For example, the determination unit 101 may determine that the user is preoccupied with the mobile terminal, that is, the user is concentrating his or her attention on the mobile terminal, if time during which the user's eyes (or eye) gazing at a specific location is equal to or longer than a predetermined threshold value, or if the number of the user's eye blink is equal to or less than a predetermined threshold value. To determine whether the user's attention is preoccupied, whether with the mobile terminal or elsewhere, photographs of the user may be taken, for example, photographs of the user's eye movement. Also, to acquire information about the movement of the user's eyes (or eye), the determination unit 101 may also control a direction of the camera using a known or to be known eye tracking technology.

The warning unit 102 alerts the user in response to, for example, the gazing time as described above being equal to or longer than a predetermined threshold value, or the number of blink being equal to or less than a predetermined threshold value. That is, if the determination unit 101 determines that the user's attention is preoccupied, the warning unit 102 may provide an alert to warn the user. It is understood that a method of alerting the user may vary according to use, application, and/or type of danger. For example, the warning unit 102 may alert the user by having a warning sign or a warning image displayed on a display of the mobile terminal. Also, the warning unit 102 may have the mobile terminal output or sound an alarm through a speaker of the mobile terminal. As additional examples, the warning unit 102 may have the mobile terminal vibrate or power down/off, or send a notice or communication to another terminal. That is, the warning unit 102 may alert another in addition to or instead of the user of the mobile terminal.

Figure 2:
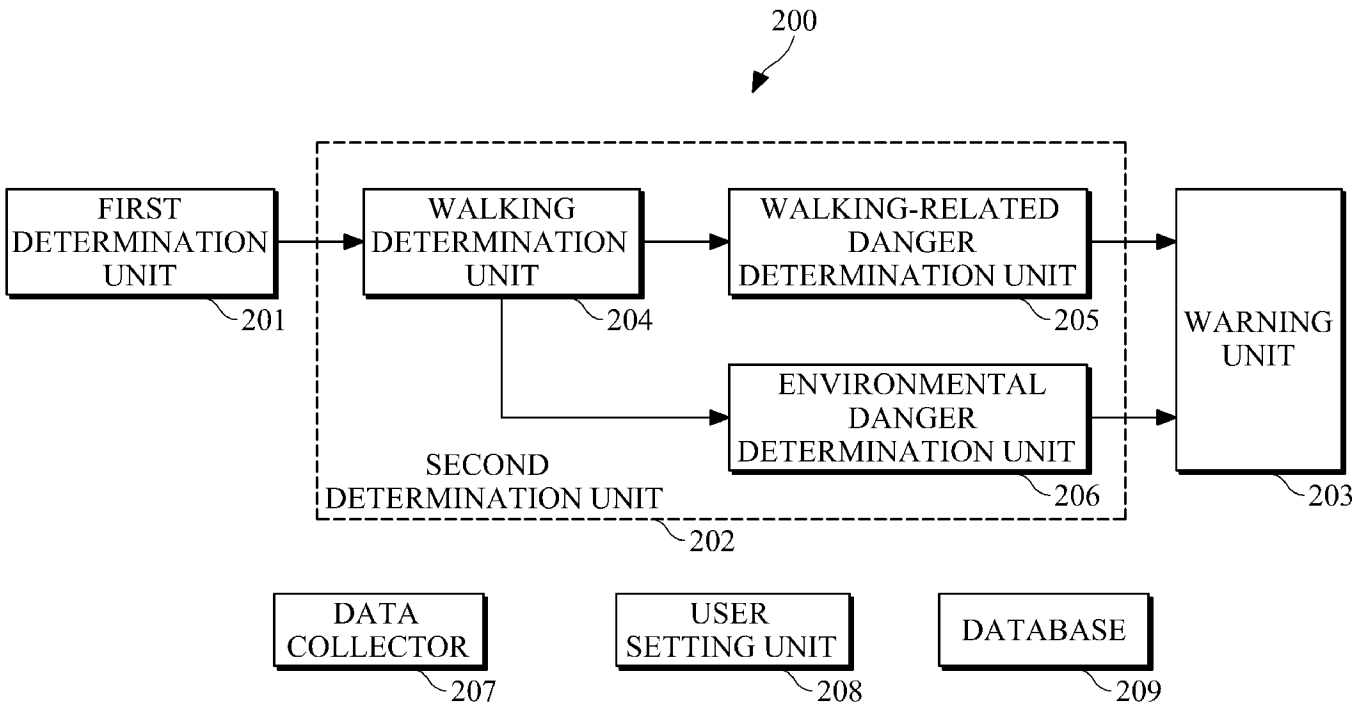
FIG. 2 is a diagram illustrating another example of a detecting apparatus.

FIG. 2 shows another example of a detecting apparatus 200 that may be provided in a mobile terminal (not shown).

Referring to FIG. 2, the detecting apparatus 200 may include a first determination unit 201, a second determination unit 202, and a warning unit 203.

The first determination unit 201 determines whether a user's attention in preoccupied, for example, whether the user's attention is preoccupied with the mobile terminal. The first determination unit 201 may measure time during which the user's eyes (or eye) are/is gazing at a specific location, also referred to as "gazing time," or count the number of the user's eye blink, also referred to as "blinking count." The determination unit 201 may measure the gazing time or blinking count based on information about movement of the user's eyes (or eye), which may be acquired by a camera of the mobile phone, and determine that the user's attention is preoccupied in response to the gazing time being equal to or longer than a predetermined threshold value, or the blinking count being equal to or less than a predetermined threshold value. To acquire information about movement of the user's eyes (or eye), the first determination unit 201 may control a direction of the photograph being taken by the camera using a known or to be known eye tracking technology.

The second determination unit 202 determines one or more factors that may be utilized by the detecting apparatus 200 to alert the user. For example, the second determination unit 202 may be activated in response to the first determination unit 201 determining that the user's attention is preoccupied. However, it is understood that the second determination unit 202 may be activated according to another signal and, for example, the outcome of the second determination unit 202 may activate the first determination unit 201 in other embodiments. As an example, a walking determination unit 204 determining that the user is walking may activate the first determination unit 201.

The second determination unit 202 may determine whether there is a "walking-related danger" and/or an "environmental danger" so as to warn the user of such potential danger(s). The second determination unit 202 may determine that there is a walking-related danger in view of various factors including factor(s) that may occur while the user is walking, and determine that there is an environmental danger in view of various factors including factor(s) that may occur in the user's surrounding whether or not the user is moving. For example, the second determination unit 202 may determine, when the user is moving, whether there is a factor of concern that the user's moving may accompany, or when the user stops, whether there is a factor of concern in the user's surrounding. As shown in FIG. 2, the second determination unit 202 may include the walking determination unit 204, a walking-related danger determination unit 205, and an environmental danger determination unit 206. It is understood that the units 204, 205 and/or 206 may carry out an operation in response to the first determination unit 201 determining that the user's attention is preoccupied with the mobile terminal, or according to another signal, or the outcome of the units 204, 205 and/or 206 may activate the first determination unit 201 in other embodiments.

The walking determination unit 204 may determine whether the user is walking. For example, the walking determination unit 204 may determine whether the user is moving or is stopped, based on information sensed by a sensor, for example, a GPS sensor and/or an accelerometer provided in the mobile terminal.

The walking-related danger determination unit 205 may determine whether the walking-related danger exists, for example, in response to the walking determination unit 204 determining that the user is moving. For example, the walking-related danger determination unit 205 may estimate a degree of walking-related danger using one or more factors including a walking state, a walking speed, and a walking stability. The degree of walking-related danger may represent a degree of danger at which a dangerous situation may occur while the user is walking. An example of how a degree of walking-related danger is estimated is described below.

A walking state, that is, a user's walking state may be determined from data sensed by an accelerometer provided in the mobile terminal. The walking state may be 'Walk,' 'Run,' etc., to correspond to whether the user is walking, running, and so on. As a non-limiting example, technology such as activity recognition may be used to determine the user's walking state. Meanwhile, a walking stability may be measured based on whether data sensed by the accelerometer is regular or irregular. As a non-limiting example, regularity analysis technology through Fourier transform may be used to measure the walking stability. Also, the user's walking speed may be measured based on data sensed by a GPS sensor provided in the mobile terminal. For example, the walking speed may be measured in unit of meter/sec or other units. After the walking state, walking speed and walking stability are obtained, a predicted danger value may be acquired with reference to a database 209 in which danger values may be stored corresponding to walking states and walking speeds, and the walking-related danger value may be obtained by reflecting a weight value corresponding to the walking stability to the predicted danger value.

The walking-related danger determination unit 205 may compare the walking-related danger value to a predetermined threshold value. For example, if the walking-related danger value is greater than the predetermined threshold value, it may be determined that there is a walking-related danger.

According to an example, the environmental danger determination unit 206 may be activated when the user is not moving and the user's attention is preoccupied, for example, when the user's attention is preoccupied with his or her mobile terminal. It is understood that this is only one example and the environmental danger determination unit 206 may be activated differently in other examples. As another example, the environmental danger determination unit 206 may be activated while the user is moving, in response to occurrence of a possibility dangerous situation.

The environmental danger determination unit 206 may sense one or more factors regarding the user's surrounding that may pose as danger. For example, the environmental danger determination unit 206 may detect an object approaching the user based on information sensed by a proximity sensor provided in the mobile terminal. Also, the environmental danger determination unit 206 may analyze sound signals collected by a microphone of the mobile terminal to detect noise, for example, an automobile horn, that may be associated with danger. For example, determining which sound is noise that may be potentially associated with a dangerous event may be accomplished with reference to the database 209 in which feature vectors of sounds may be stored. The environmental danger determination unit 206 may also compare the user's location acquired through a GPS sensor of the mobile terminal to locations where accidents often occur and/or to dangerous regions. Such locations and information may be stored in the database 209. As the examples illustrate, a potential environmental danger may be determined by the environmental danger determination unit 206.

The warning unit 203 may provide an alarm in response to a walking-related danger and/or an environmental danger. It is understood various altering methods may be implemented and different warnings may be provided according to different use, application, or types of danger. For example, the warning unit 203 may display a warning word, sign, and/or image on a display of the mobile terminal. In addition to or instead of, the warning unit 203 may output or sound an alarm through a speaker of the mobile terminal. Also, the warning unit 203 may vibrate or power down/off the mobile terminal, or send urgent notice or communication to another terminal.

According to an embodiment, the danger detecting apparatus 200 may primarily detect danger depending on whether a user's attention is preoccupied, for example, whether the user's attention is focused or concentrated on the mobile terminal, and may secondarily detect a walking-related danger and/or an environmental danger according to the user's state and/or environment. It is understood that this is one of many embodiments taught herein. The danger detecting apparatus 200 may be used to warn and/or prevent danger that the user may be potentially exposed to in advance.

According to another embodiment, the danger detecting apparatus 200 may further include a data collector 207, a user setting unit 208, and the database 209.

The data collector 207 may collect and provide various sensor data for the first and second determination units 201 and 202. The data collector 207 may collect data from various sensors of the mobile terminal. The collected data may include, for example, GPS data, accelerometer data, gyroscope data, image data, sound data, sensing data of a proximity sensor, and network data.

The user setting unit 208 may set threshold values for the first and second determination units 201 and 202. For example, where the first determination unit 201 is determining whether the user's attention is preoccupied with the mobile terminal based on information about movement of the user's eyes (or eye), the user setting unit 208 may set a reference value corresponding to a gazing time or a reference value corresponding to a blinking count that may be used to compared to the information about movement of the user's eyes (or eye). Also, where the second determination unit 202 is determining whether there is potential danger based on a predetermined degree of walking-related danger, the user setting unit 208 may set a reference value based on which whether a potential walking-related danger exists can be determined. In addition, the user setting unit 208 may change a warning method that is executed by the warning unit 203.

The database 209 may store danger values for walking states and walking speeds, information about locations where accidents often occur or of dangerous regions, and feature vectors of noise that may be associated with danger.

FIG. 3 shows an example of a database of walking-related danger value. The walking-related danger value may be stored in the database 209 described above.

Referring to FIGS. 2 and 3, a degree of walking-related danger may depend on a walking speed 301 and a walking state 302. For example, if a user is walking at a speed of 5 m/s, a degree of walking-related danger may be determined to be 4. The walking speed 301 and walking state 302 may be acquired by analyzing values sensed by the GPS sensor and accelerometer of the mobile terminal.

After a degree of walking-related danger is determined according to the walking speed 301 and walking state 302, the walking-related danger determination unit 205 may compare the degree of walking-related danger to a predetermined threshold value, and for example, determine that there is potential danger if the degree of walking-related danger is equal to or greater than the predetermined threshold value.

Also, the degree of walking-related danger determined with reference to the database illustrated in FIG. 3 may be used as a predicted danger value. For example, if a degree of walking-related danger is determined to be 4, the degree of walking-related danger may increase or decrease depending on walking stability, so as to obtain a final degree of walking-related danger. The walking stability may depend on the amount of changes in signals, for example, values from the GPS sensor or accelerometer, used to acquire the walking speed 301 and walking state 302.

Figure 4:
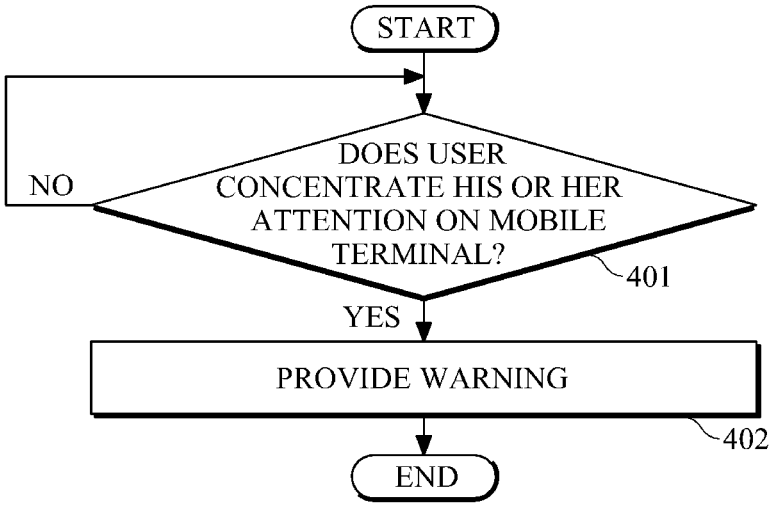
FIG. 4 is a flowchart illustrating an example of a detecting method.

FIG. 4 shows a flowchart illustrating an example of a detecting method. The detecting method may be carried out by a detecting apparatus consistent with FIG. 1.

Referring to FIGS. 1 and 4, it is determined whether a user's attention is preoccupied, for example, whether the user is concentrating his or her attention on a mobile terminal (401). For example, the determination unit 101 may check whether the user's eyes (or eye) are/is gazing or fixed to a specific location for a time exceeding a predetermined time, or whether the number of the user's eye blink falls below a predetermined value, to determine whether the user's attention is preoccupied.

In response to the user's attention being preoccupied, a warning is provided (402). For example, the warning unit 102 may provide a warning by displaying a warning word, sign, and/or image, have the mobile terminal vibrate, powering down/off the mobile terminal, output or sound an alarm, and/or send a notice communication to another terminal.

Figure 5:
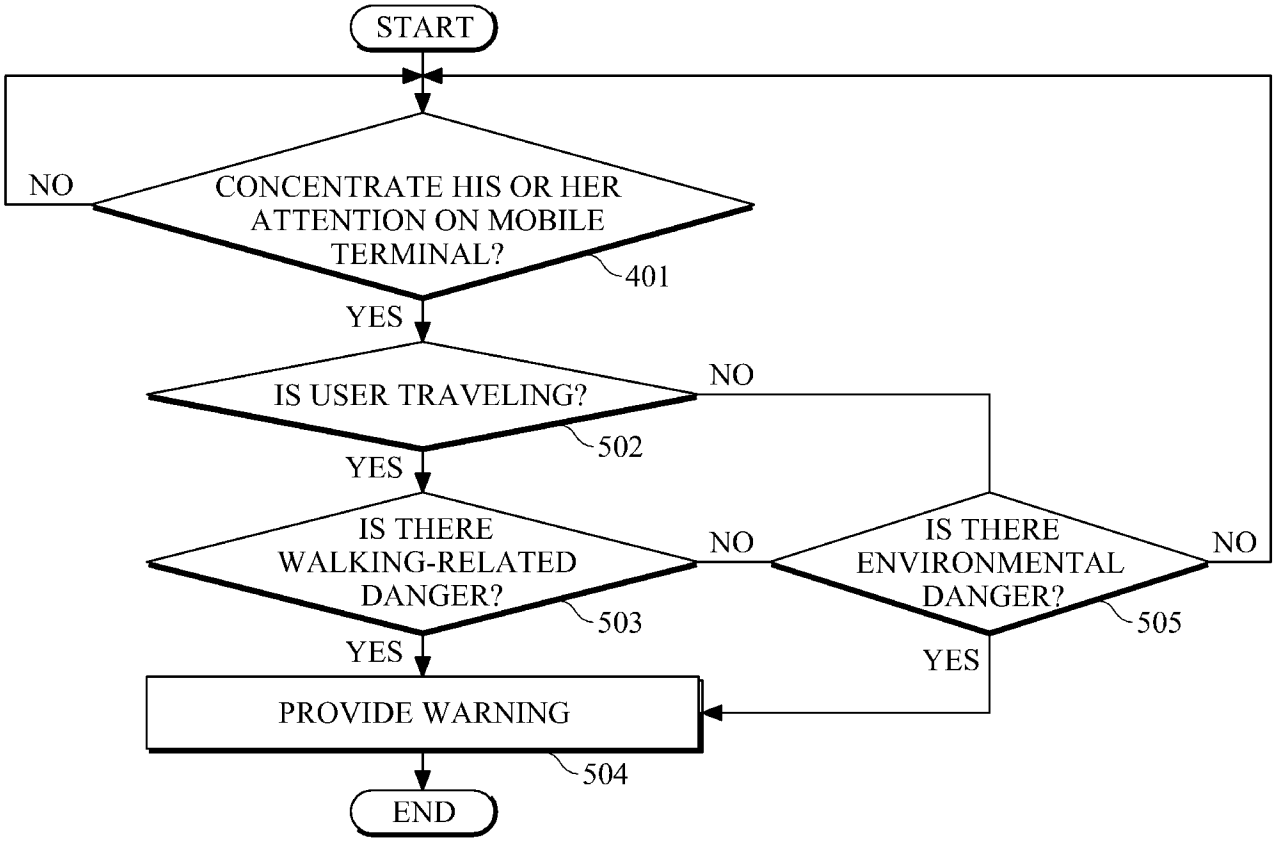
FIG. 5 is a flowchart illustrating another example of a detecting method.

FIG. 5 shows a flowchart illustrating another example of a detecting method. The detecting method may be carried out by a detecting apparatus consistent with FIG. 2.

Referring to FIGS. 2 and 5, it is determined whether a user's attention is preoccupied, for example, whether the user is concentrating his or her attention on a mobile terminal (501). For example, the first determination unit 201 may check whether the user's eyes (or eye) are/is gazing or fixed to a specific location for a time exceeding a predetermined time, or whether the number of the user's eye blink falls below a predetermined value, to determine whether the user's attention is preoccupied.

In response to the user's attention being preoccupied, it is determined whether the user is moving (502). For example, the walking determination unit 204 may determine whether the user is moving or stopped based on GPS data and/or data from an accelerometer.

If the user is moving, it is determined whether there is a walking-related danger (503). For example, the walking-related danger determination unit 205 may compare a degree of walking-related danger to a predetermined threshold value to determine whether there is danger. The walking-related danger determination unit 205 may obtain a walking state, a walking speed, and a walking stability based on GPS data and accelerometer/gyroscope data. A first degree of danger may be obtained based on the walking state and walking speed with reference to a database as illustrated in FIG. 3, and a weight value corresponding to the walking stability may be reflected to the first degree of danger to obtain a second degree of danger. If the second degree of danger is greater than a threshold value, it may be determined that there is a walking-related danger, and otherwise, it may be determined that there is no walking-related danger.

In response to determining that there is a walking-related danger, a warning is provided (504). For example, the warning unit 203 may provide a warning by displaying a warning word, sign, and/or image, outputting sound, having the mobile terminal vibrate, powering down/off the mobile terminal, and/or sending a notice or communication to another terminal.

Also, if the user is not moving (502), or in response to determining that there is no walking-related danger although the user is moving (503), it is determined whether there is an environmental danger (505). For example, the environmental danger determination unit 206 may determine whether an object is approaching, whether noise corresponding to potentially a dangerous situation is generated, and/or whether the user is entering a region of interest such as a region where an accident or crime is known to occur or a region with known or reported construction, natural disaster, and/or weather or other issue. The determination may be made based on data from, for example, a proximity sensor, a microphone, a network, and the database 209.

In response to there being an environmental danger, a warning is provided (504).

Figure 6:
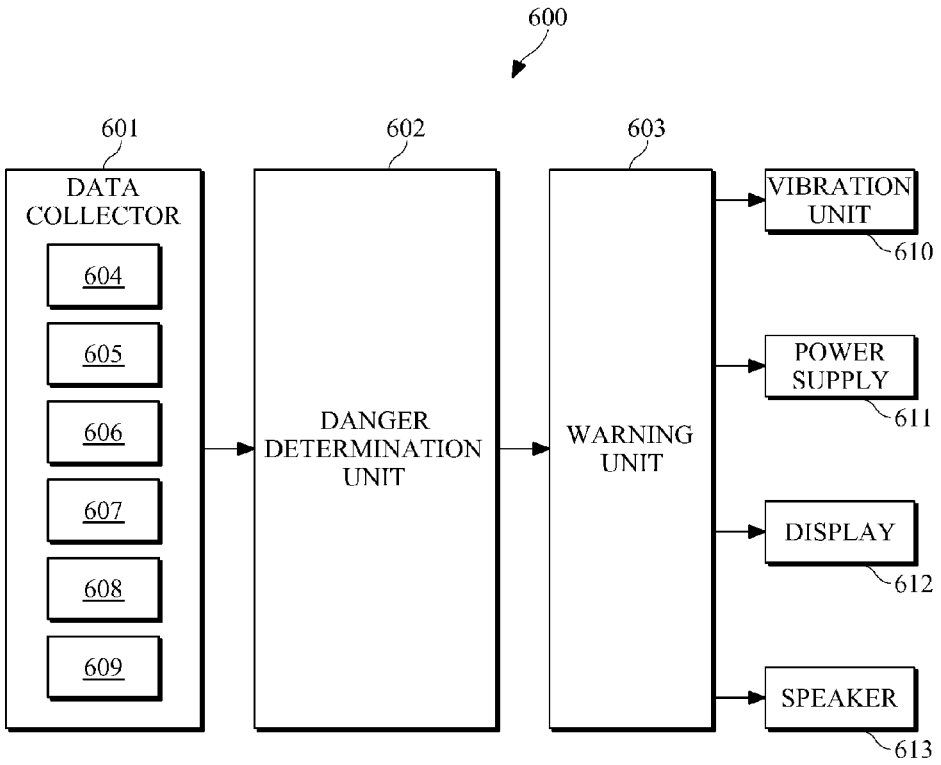
FIG. 6 is a diagram illustrating an example of a mobile terminal.

FIG. 6 shows an example of a mobile terminal 600.

Referring to FIG. 6, the mobile terminal 600 may include a data collector 601, a determination unit 602, and a warning unit 603.

The data collector 601 may collects various information about the mobile terminal 600 and a user with the mobile terminal 600. For example, the data collector 601 may include one or more modules including a GPS module 604 to measure the user's walking speed, an accelerometer module 605 to determine the user's walking state and/or stability, a proximity sensor module 606 to detect an object approaching the user, a network module 607 to receive information, for example, information about region(s) of interest through a communication network, a camera module 608 to collect information about the user's eyes (or eye) and/or the user's surrounding, and a microphone module 609 to detect noise around the user.

The determination unit 602 may determine whether the user is preoccupied, whether the user is walking, whether a walking-related danger exists, and/or whether an environmental danger exists, based on the information collected by the data collector 601. For example, the determination unit 602 may determine whether the user's attention is preoccupied, based on information about movement of the user's eyes (or eye), which is acquired by the camera module 608. If the user's attention is preoccupied, for example, with the mobile terminal 600, this may signal that potential danger exist that can be categorized as a primary danger in one example embodiment. The determination unit may also determine whether other potential danger(s) exist that may be categorized as a secondary danger in the example embodiment. For example, the determination unit 602 may determine whether the user is moving, based on GPS data acquired by the GPS module 604 and/or acceleration data acquired by the accelerometer module 605. Also, the determining unit 602 may determine, when the user is moving, whether the walking-related danger exists, and determines, when the user is not moving or if no walking-related danger exists, whether the environmental danger exists.

The warning unit 603 may provide a warning in response to the user being preoccupied, for example, his or her attention being preoccupied with the mobile terminal 600, in response to there being a walking-related danger, and/or in response to there being an environmental danger. For example, the warning unit 603 may control a vibration unit 610 to vibrate the mobile terminal 600. Also, the warning unit 603 may control a power supply 611 to power down/off the mobile terminal 600. Also, the warning unit 603 may control a display 612 to display a warning word, sign, and/or image. Further, the warning unit 603 may control a speaker 613 to output or sound an alarm.

According to certain examples described above, a user of a mobile terminal may be provided with a warning for potential danger in advance so as to allow user to prepare for or avoid the potential danger.

It is understood that a detecting apparatus may be integrated, in whole or in part, with a mobile terminal, or provided as a separate unit, in whole or in part(s). For example, a part of the detecting apparatus may be integrated with the mobile terminal while a part provided as a separate hardware and/or software recorded, stored, or fixed in one or more computer-readable storage media, for example, application software recorded, stored, or fixed in one or more computer-readable storage media. It will be understood that other variations may be made without departing from the teaching provided herein.

A detecting apparatus and a determining unit have been described herein to determine whether a user is preoccupied. With respect to the term "preoccupied" with respect to a user, it is understood that the user may be "preoccupied" because his/her attention is directed or focused on a mobile terminal, but also because the user may be "preoccupied" for other reasons. For example, the user may be "preoccupied" because his/her attention is directed or focused on an object other than the mobile terminal while walking and/or talking to someone over the mobile terminal. As another example, the user may be "preoccupied" because the user may be falling asleep while driving and the detecting apparatus or the determining unit of the mobile terminal may recognize this event. Accordingly, it is understood that a user being preoccupied with a mobile terminal in the examples above is provided as a non-limiting illustrative purpose only and that embodiments are not limited thereto.

The processes, functions, methods and/or software described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable media include magnetic media, such as hard disks, floppy disks, and magnetic tape; optical media such as CD ROM disks and DVDs; magneto-optical media, such as optical disks; and hardware devices that are configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules that are recorded, stored, or fixed in one or more computer-readable storage media, in order to perform the operations and methods described above, or vice versa. In addition, a computer-readable storage medium may be distributed among computer systems connected through a network and computer-readable codes or program instructions may be stored and executed in a decentralized manner.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A detecting apparatus for a mobile terminal, comprising:

an accelerometer;

a determination unit configured to optically determine whether a user's attention is preoccupied and determine whether the user is moving or stationary;

a walking-related danger determination unit configured to determine, in response to a determination that the user is moving, whether there is a walking-related danger to the user in order to avoid potential danger by selecting, based on a walking state and a walking speed of the user, a danger value from among a plurality of danger values as a predicted danger value, the plurality of danger values being stored in a database corresponding to walking states and walking speeds, and determining a walking-related danger value by applying a weight value corresponding to a walking stability of the user to the predicted danger value, and determine, in response to a determination that the user is stationary or that there is no walking-related danger, whether an environmental danger exists for the user based on whether sound or noise around the user corresponds to a dangerous situation or exceeds a predetermined threshold value, whether the user has entered a region of interest, or a combination thereof; and a warning unit configured to provide an alert, in response to determining that the walking-related danger or the environmental danger is present or that the user's attention is preoccupied.

2. The detecting apparatus of claim 1, wherein the determination unit determines whether the user's attention is preoccupied based on a time during which one or more of the user's eyes are gazing at a location, a number of the user's eye blinks, or a combination thereof.

3. A detecting apparatus for a mobile terminal, comprising:

an accelerometer;

a first determination unit configured to optically determine whether a user's attention is preoccupied;

a second determination unit configured to determine one or more factors indicative of danger to the user utilized by the detecting apparatus to provide an alert; and a warning unit configured to provide an alert based on a determination of the first determination unit, a determination of the second determination unit, or a combination thereof, wherein the second determination unit comprises:

a walking determination unit configured to determine, in response to a determination that the user's attention is preoccupied, whether the user is moving or stationary;

a walking-related danger determination unit configured to determine, in response to a determination that the user is moving, whether there is a walking-related danger to the user in order to avoid potential danger by selecting, based on a walking state and a walking speed of the user, a danger value from among a plurality of danger values as a predicted danger value, the plurality of danger values being stored in a database corresponding to walking states and walking speeds, and determining a walking-related danger value by applying a weight value corresponding to a walking stability of the user to the predicted danger value; and an environmental danger determination unit configured to determine, in response to a determination that the user is stationary or that there is no walking-related danger, whether an environmental danger exists for the user based on whether sound or noise around the user corresponds to a dangerous situation or exceeds a predetermined threshold value, whether the user has entered a region of interest, or a combination thereof, the environmental danger comprising one or more factors which may occur by the user's surrounding whether or not the user is moving.

4. A detecting method for a mobile terminal, the method comprising:

optically determining by a determination unit, whether a user's attention is preoccupied and whether the user is moving or stationary;

determining, in response to a determination that the user is moving, whether there is a walking-related danger to the user in order to avoid potential danger by selecting, based on a walking state and a walking speed of the user, a danger value from among a plurality of danger values as a predicted danger value, the plurality of danger values being stored in a database corresponding to walking states and walking speeds, and determining a walking-related danger value by applying a weight value corresponding to a walking stability of the user to the predicted danger value;

determining, in response to a determination that the user is stationary or that there is no walking-related danger, whether an environmental danger exists for the user based on whether sound or noise around the user corresponds to a dangerous situation or exceeds a predetermined threshold value, whether the user has entered a region of interest, or a combination thereof; and providing an alert by a warning unit, in response to determining that the walking-related danger or the environmental danger is present or that the user's attention is preoccupied.

5. The detecting method of claim 4, wherein the determining comprises determining whether the user's attention is preoccupied based on a time during which one or more of the user's eyes are gazing at a location, a number of the user's eye blinks, or a combination thereof.

6. A detecting method for a mobile terminal, the method comprising:

optically determining by a first determination unit, whether a user's attention is preoccupied;

determining by a second determination unit, one or more factors indicative of danger to the user utilized to provide an alert; and providing an alert by a warning unit, based on whether the user's attention is preoccupied, the one or more factors, or a combination thereof, wherein the determining of the one or more factors comprises:

determining, in response to a determination that the user's attention is preoccupied, whether the user is moving or stationary;

determining, in response to a determination that the user is moving, whether a walking-related danger exists for the user in order to avoid potential danger by selecting, based on a walking state and a walking speed of the user, a danger value from among a plurality of danger values as a predicted danger value, the plurality of danger values being stored in a database corresponding to walking states and walking speeds, and determining a walking-related danger value by applying a weight value corresponding to a walking stability of the user to the predicted danger value; and determining, in response to a determination that the user is stationary or that no walking-related danger exists for the user, whether an environmental danger exists for the user based on whether sound or noise around the user corresponds to a dangerous situation or exceeds a predetermined threshold value, whether the user has entered a region of interest, or a combination thereof, the environmental danger comprising one or more factors which may occur by the user's surrounding whether or not the user is moving.

7. A mobile terminal comprising:

a data collector comprising an accelerometer module configured to detect a user's walking state and stability, a GPS module to measure the user's walking speed, and one or more modules among a proximity sensor module to detect an object approaching the user, a network module to receive information through a communication network, a camera module to collect information about the user or the user's surrounding, and a microphone module to detect sound or noise around the user;

a determination unit configured to optically determine, based on data collected by the data collector, whether the user's attention is preoccupied and whether the user is moving or stationary, whether there is a walking-related danger in order to avoid potential danger in response to determining that the user is moving, and whether there is an environmental danger in response to determining that the user is stationary; and a warning unit configured to provide an alert in response to the user's attention being preoccupied, in response to there being a walking-related danger, or in response to there being an environmental danger, according to a determination by the determination unit, wherein the determination unit is configured to determine whether there is a walking-related danger by selecting, based on a walking state and a walking speed of the user, a danger value from among a plurality of danger values as a predicted danger value, the plurality of danger values being stored in a database corresponding to walking states and walking speeds, and determining a walking-related danger value by applying a weight value corresponding to a walking stability of the user to the predicted danger value, and determine whether an environmental danger exists for the user based on whether sound or noise around the user corresponds to a dangerous situation or exceeds a predetermined threshold value, whether the user has entered a region of interest, or a combination thereof, and wherein the environmental danger comprises one or more factors which may occur by the user's surrounding whether or not the user is moving.

8. The mobile terminal of claim 7, wherein the determination unit:

determines, in response to the user's attention being preoccupied, whether the user is moving; and determines, when it is determined that the walking-related danger does not exist, whether there is an environmental danger for the user.

9. The detecting apparatus of claim 3, wherein the walking related danger determination unit compares the walking-related danger value to a predetermined threshold value to determine whether there is a walking-related danger for the user.

10. The mobile terminal of claim 8, wherein the determination unit determines that the user is moving, based on a GPS data acquired by the GPS module, an acceleration data acquired by the accelerometer module, or a combination thereof.

11. The detecting apparatus of claim 1, wherein the determination unit determines that the user's attention is preoccupied in response to the user concentrating on the mobile terminal longer than a threshold value.

12. The detecting apparatus of claim 1, wherein the determination unit is configured to determine whether the user's attention is preoccupied, based on information related to the user's eye movement.

13. The detecting method of claim 6, wherein the determining of whether the walking-related danger exists for the user further comprises comparing the walking-related danger value to a predetermined threshold value to determine whether the walking-related danger exists for the user.

14. The detecting apparatus of claim 3, further comprising:

a data collector configured to collect data from one or more sensors of the mobile terminal;

a user setting unit configured to set a threshold value for the first determination unit and a threshold value for the second determination unit; and a database configured to store danger values for at least one of information of locations with reported accidents or of regions with reported danger, and feature vectors of noise associated with danger.

* * * * *